US006981962B1

(12) United States Patent
Lenkersdorf

(10) Patent No.: US 6,981,962 B1
(45) Date of Patent: Jan. 3, 2006

(54) LIQUID DISPENSING DEVICE

(76) Inventor: Boyd J. Lenkersdorf, 4005 Gem Lake Dr., West Palm Beach, FL (US) 33406

( * ) Notice: Subject to any disclaimer, the term of this patent is extended or adjusted under 35 U.S.C. 154(b) by 97 days.

(21) Appl. No.: 10/731,835

(22) Filed: Dec. 9, 2003

(51) Int. Cl.
*A61J 7/00* (2006.01)

(52) U.S. Cl. ..... 604/78; 604/218; 222/133; 220/521

(58) Field of Classification Search ..... 606/326, 606/236; 604/82, 218, 77, 78; 222/133; 220/521, 714
See application file for complete search history.

(56) References Cited

U.S. PATENT DOCUMENTS

| | | | | |
|---|---|---|---|---|
| 3,302,644 | A | 2/1967 | Kennedy | |
| 4,810,245 | A | 3/1989 | Aagesen | |
| 4,821,895 | A | 4/1989 | Roskilly | |
| 5,129,532 | A | 7/1992 | Martin | |
| 5,176,705 | A | 1/1993 | Noble | |
| 5,244,122 | A | 9/1993 | Botts | |
| 5,383,906 | A | 1/1995 | Burchett | |
| 5,431,680 | A | 7/1995 | Jones | |
| 5,487,750 | A | 1/1996 | Burchett | |
| 5,542,922 | A | 8/1996 | Petterson | |
| 5,598,939 | A | 2/1997 | Watson | |
| 5,824,012 | A | 10/1998 | Burchett | |
| 5,938,053 | A | 8/1999 | Verbovszky | |
| 6,126,679 | A * | 10/2000 | Botts | 606/236 |
| 6,139,566 | A | 10/2000 | Bennett | |
| 6,200,295 | B1 | 3/2001 | Burchett | |
| 6,270,519 | B1 | 8/2001 | Botts | |
| 2004/0000551 | A1 * | 1/2004 | Flink et al. | 220/258.3 |
| 2005/0092754 | A1 * | 5/2005 | Marsden et al. | 220/521 |

* cited by examiner

*Primary Examiner*—Roy D. Gibson
(74) *Attorney, Agent, or Firm*—Charles J. Prescott

(57) ABSTRACT

A liquid dispensing device for the selective oral administration of a liquid medicine simultaneously with a liquid beverage. The device includes a cup for holding a beverage and a lid sealably connectable onto the open upper end of the cup. The cup includes an elongated cylindrical medicine cavity having an open lower end and a narrowing upper discharge tip. The medicine cavity is formed into the outer perimeter surface of the cup for concealment. A medicine plunger is sealingly movable within the medicine cavity for discharging liquid medicine from the discharge tip. The lid has a tapered upwardly extending drinking spout with preferably two spaced ports and a second port positioned between the first ports whereby liquid beverage in the cup may be dispensed from the first ports by gravity feed and liquid medicine in said medicine cavity may be independently selectively dispensed from the second port by movement of the medicine plunger.

4 Claims, 4 Drawing Sheets

52
50
52
D
C
D
54
48
14
46
10
22
23
56
B
58
20
24
44
40
E
E
26
28
30
34
12
36
16
38
18
32
A
42
60

LIQUID DISPENSING DEVICE

CROSS-REFERENCE TO RELATED APPLICATIONS

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to devices for dispensing a beverage and a liquid medicant from a beverage containing bottle or cup, and more particularly to a liquid dispensing device which will simultaneously dispense a liquid beverage and a liquid medicine from a single spout formed as a unit with a lid sealably attachable to a cup or container.

2. Description of Related Art

The use of conventional upwardly opening cups for holding a quantity of a liquid beverage for consumption by a child will typically lead to spilled liquid beverage both on the child and on the floor. Sipping cups having a sealable lid with an upwardly opening spout provide a somewhat more controlled and less messy administration of a liquid beverage to a child and are well known.

Administering a liquid medicant or medicine to a young child may also be somewhat problematic, especially if the liquid medicine has a strong or offensive taste or smell. A number of prior art devices are known to simultaneously administer both a liquid beverage and a liquid medicant to the child through a rigid or flexible upper spout or nipple and are disclosed in the following U.S. Patents.

U.S. Pat. No. 4,810,245 issued to Aagesen
U.S. Pat. No. 5,129,532 issued to Martin
U.S. Pat. No. 5,244,122 issued to Botts
U.S. Pat. No. 5,938,054 issued to Verbovszky
U.S. Pat. No. 5,824,012 issued to Burchett et al.
U.S. Pat. No. 5,542,922 issued to Petterson, et al.
U.S. Pat. No. 5,383,906 issued to Burchett et al.
U.S. Pat. No. 5,176,705 issued to Noble
U.S. Pat. No. 6,200,295 issued to Burchett et al.
U.S. Pat. No. 6,270,519 issued to Botts
U.S. Pat. No. 5,487,750 issued to Burchett et al.
U.S. Pat. No. 6,139,566 issued to Bennett
U.S. Pat. No. 3,302,644 issued to Kennedy et al.
U.S. Pat. No. 4,821,895 issued to Roskilly
U.S. Pat. No. 5,431,680 to Jones
U.S. Pat. No. 5,598,939 to Watson et al.

Of particular interest is the cup with cover invented by Aagesen in U.S. Pat. No. 4,810,245. This disclosure does teach a rigid molded cup having a cover sealably attached to an upper end thereof which includes an integrally formed spout having two passages formed therethrough. One of the passages is in fluid communication with the interior of the cup and is presumed to be for dispensing a liquid beverage. The other elongated passageway is in fluid communication with an elongated cylindrical cavity for receiving a syringe, including elongated needle attached thereto for the simultaneous dispensing the liquid beverage from the container and a liquid medicine from the syringe held within the elongated adapter (5).

BRIEF SUMMARY OF THE INVENTION

This invention is directed to a liquid dispensing device for the selective oral administration of a liquid medicine simultaneously with a liquid beverage. The device includes a liquid containing cup for holding a beverage and a lid sealably connectable onto the open upper end of the cup. The cup includes an elongated cylindrical medicine cavity having an open lower end thereof and a narrowing upper discharge tip in proximity to an upper end of the cup opening. The medicine cavity is positioned within an outer perimeter surface of the cup for concealment. A medicine plunger is sealingly engageable for longitudinal movement within the medicine cavity for discharging liquid medicine from the discharge tip responsive to movement of the medicine plunger. The lid has a tapered upwardly extending drinking spout with a first drinking port in fluid communication with the interior of the cup and a second port spaced adjacent to said first port in fluid communication with the medicine cavity whereby liquid beverage in the cup may be dispensed from the first port by gravity feed and liquid medicine in said medicine cavity may be independently selectively dispensed from the second port by movement of the medicine plunger.

It is therefor an object of this invention to provide a device for holding and selective simultaneous distribution of a liquid beverage and a liquid medicine orally to a young child.

Still another object of this invention is to provide a device which will dispense a liquid beverage through an upper sipping or sucking spout when inverted, a syringe plunger also selectively administering the liquid medicine from a separate molded syringe cavity formed into the side of the cup in concealed fashion.

Still another object of this invention is to provide a device for the oral dispensing of a liquid beverage to a child and the selective simultaneous dispensing of a liquid medicament, both of which are dispensed orally through a somewhat conically tapered drinking tip formed as a unit with a molded lid sealably attachable to the upper open end of the beverage containing cup.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
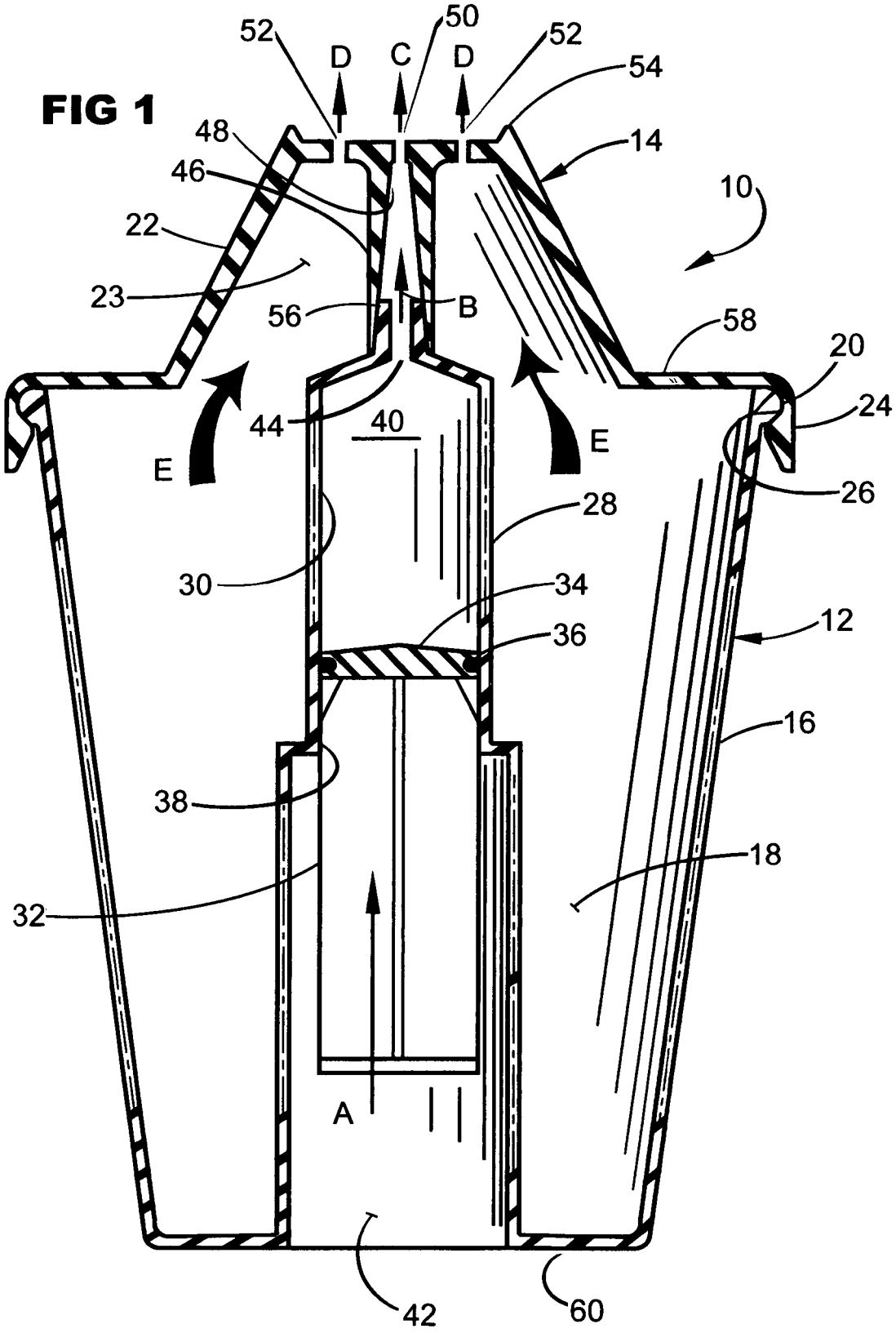
FIG. 1 is a side elevation section view of the invention.
Figure 2:
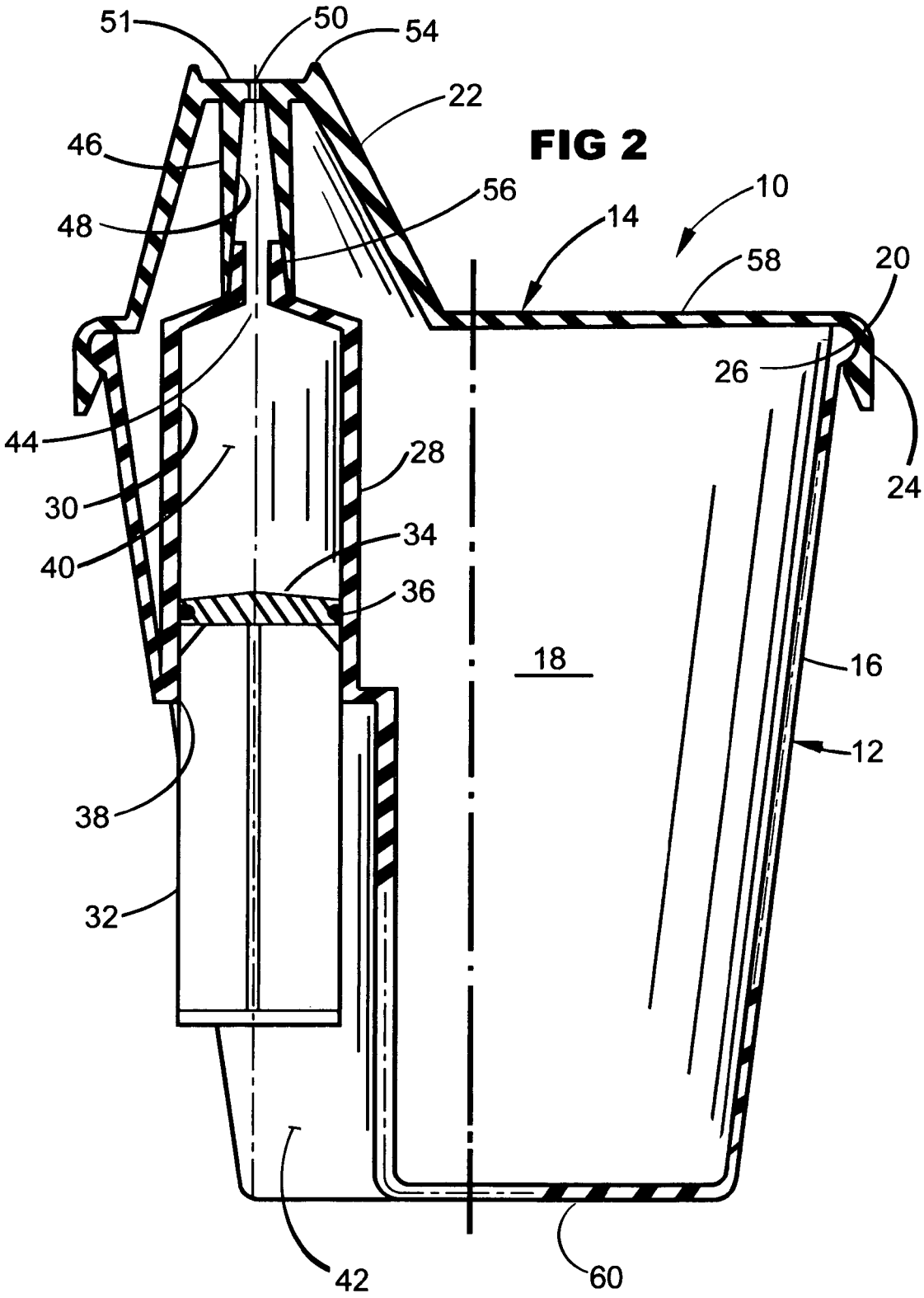
FIG. 2 is a front elevation section view of the invention.
Figure 3:
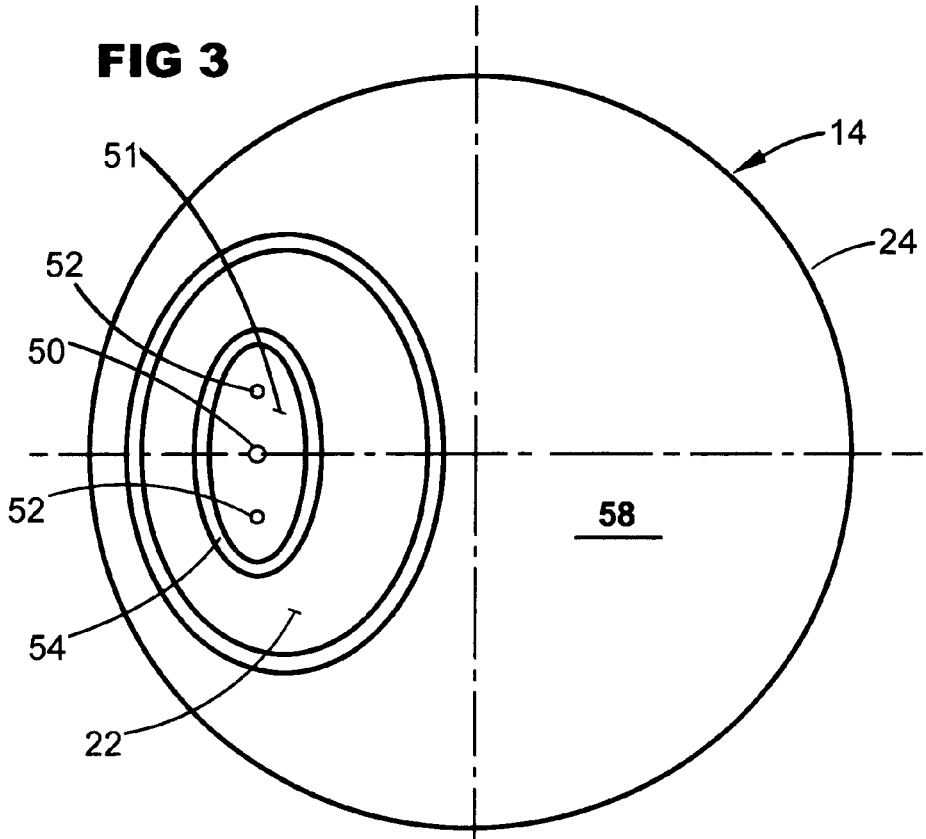
FIG. 3 is a top plan view of the invention.
Figure 4:
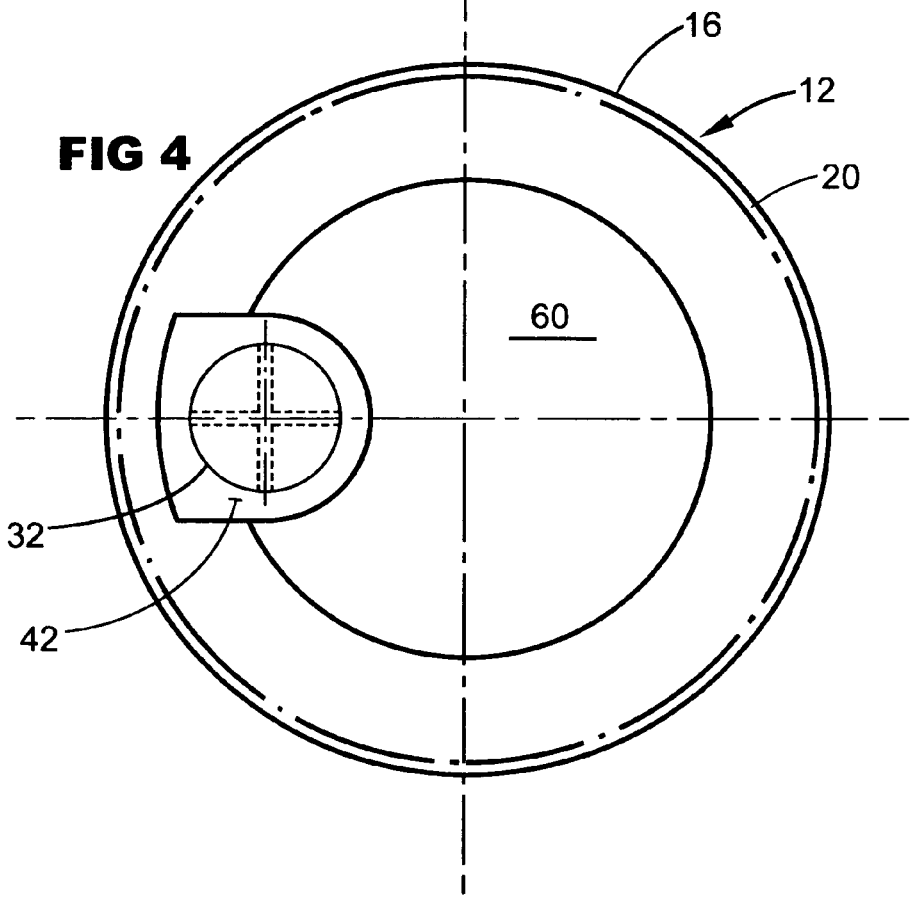
FIG. 4 is a bottom plan view of the invention.

Referring now to the drawings, the invention is there shown in FIGS. 1 and 2 generally at numeral 10 and includes a molded cup 12 formed as a unit of either transparent or opaque plastic material and a lid 14 also mold formed of transparent or opaque plastic material. The cup 12 has a truncated generally conical outer surface 16 and a lower flat bottom 30 and an upper molded outwardly extending bead or lip 20 forming the open upper end of the cup 12.

The cup 12 generally defines a liquid beverage holding cavity 18 for holding any selected form of liquid beverage for consumption by a child. The cup 12 also includes a molded medicine cavity 40 having an inner cylindrical sidewall 28 which is open at a lower end 38 thereof. An upper end of the medicine cavity 40 is tapered into a nozzle type opening 44 formed centrally through an elongated tapered discharge tip 56. An elongated medicine plunger 32 having a disc-shaped upper end 34 thereof is sealingly engageable, for example, by a flexible O-ring 36 or by thin wall interference fit (not shown) against the inner cylindrical surface 30 of the medicine cavity 40. The elongated shape of the medicine plunger 32 facilitates its movement in the direction of arrow A to urge liquid medicine placed into the medicine cavity 40 prior to insertion of the medicine plunger 32 out through the opening 44.

Note that an enlarged clearance cavity 42 which is formed into the side of the cup 12 and extends to a bottom 60 of the cup 12, and is open at a bottom end thereof provides clearance and access to insert the medicine plunger 32 into the medicine cavity 40 after the appropriate liquid medicine has been poured into the medicine cavity 40 with the device 10 in an inverted position. Note that the lower distal end of the plunger 32, by its design length and that of cavity 40, is always above this bottom 60 so that the device 10 is always supportable in an upright position without interference from the plunger 32.

The lid perimeter bead 20 snappingly engages into a recess 26 formed into a circular flange 24 extending orthogonally from the flat central portion 58 of the lid 14. The recess 26 of flange 24 is molded so as to tightly snappingly engage onto the beaded rim 20 of the cup 12 to affect a liquid seal therebetween.

The lid 14 also includes an upwardly extending sipping spout 22 which, as shown, is configured to have a truncated conical-like in shape having a flat upper distal surface 51 and upwardly tapering side walls forming of an oval or elliptic shaped cone as shown. A raised lip 54 surrounds and forms a perimeter of the flat upper surface 51 into which is formed two beverage dispensing apertures 52 and a central liquid medicine dispensing aperture 50. This raised lip 54 enhances mixing or co-mingling of beverage and medicine before touching the child's mouth.

Each beverage dispensing aperture 52, as best seen in FIG. 1, is in fluid communication with liquid beverage held within the interior 18 of cup 12 whereby, when the device 10 with 14 secured in place as shown, is inverted, the liquid beverage will flow in the direction of arrows E for discharge from the beverage dispensing aperture 52 for oral consumption typically by a child. The tapered surfaces of spout 22, in combination with the raised perimeter flange or bead 54, appear to reduce spillage and increase beverage consumption efficiency by the child.

The central liquid medicine dispensing port 50 is in fluid communication with a connecting tube 46 which is formed with and downwardly extends from upper surface 51 and having a tapered inner surface 48 leading to port 50. This tapered surface 48, in combination with the selected length of the connecting tube 46, sealingly engage onto the tapered outer surface 56 of the medicine cavity 40 such that, when liquid medicine is placed into the medicine cavity 40 with the medicine plunger 32 in position, movement of the medicine plunger 32 in the direction of arrow A will force the liquid medicine into the connecting tube 46 in the direction of arrow B for discharge in the direction of arrow C through port 50.

Note that the liquid beverage within the interior 18 of the device 10 will flow by gravity or sucking action of the child through the beverage ports 52 while the flow of liquid medicine through port 50 is selectively controlled by the movement of the medicine plunger 32 which effects discharge of the liquid medicine from medicine port 50 in a mixed fashion once dispensed in the mouth of the young child such that unpleasant or medicinally tasting liquid medicine is disguised by the more delightful taste of the liquid beverage being consumed through ports 52. The mixing or co-mingling of liquid beverage and medicine is enhanced by the close proximity of these ports and preferably further enhanced by having a beverage portion on either side of the medicine port 50.

Figure 5:
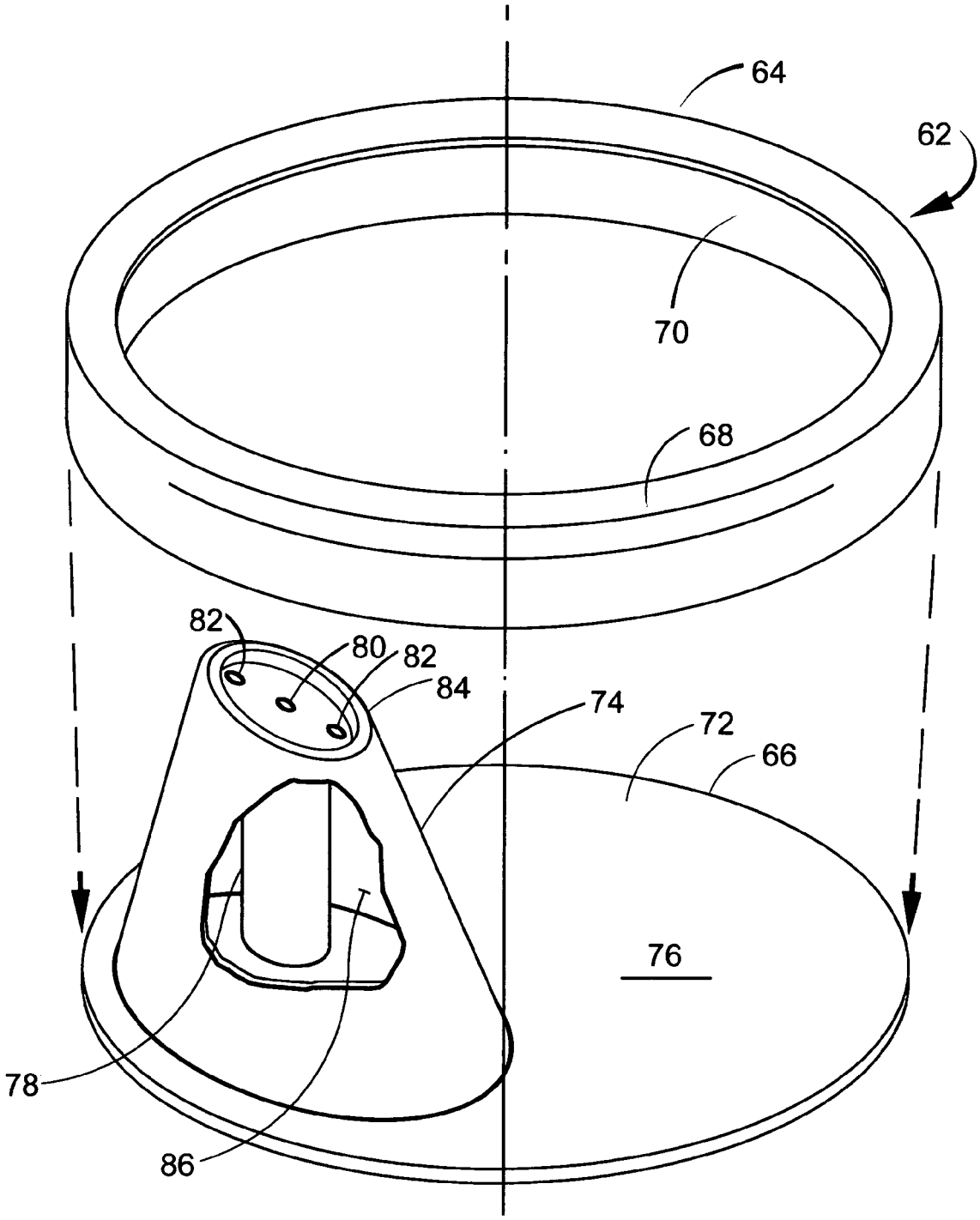
FIG. 5 is an exploded perspective view of an alternate two-piece embodiment of the lid with spout.

The preferred configuration of lid 14 is that of a molded plastic component formed as a unit with the flange 24. However, as seen in FIG. 5, the lid assembly 62 may be in two parts with the flat disc-shaped central portion 76 molded as a unit with the tapered spout 74 being lockably engaged in place on the open upper end of the cup by locking ring 64, the threadable interior surface 70 being lockably engageable onto the matingly configured upper end of the cup (not shown), the inwardly extending flange 68 locking the disc-shaped body 76 in sealing engagement onto the open upper end of the cup.

In this embodiment 62, the spout 74 also includes spaced beverage dispensing ports 84 which are in fluid communication through interior volume 76 with the liquid beverage within the cup while the medicine dispensing port 80 extending through the elongated connecting tube 76 which engages onto the tapered upper connecting tube 56 of the medicine cavity 40 as previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A liquid dispensing device for the un-commingled simultaneous oral administration of a liquid medicine and a liquid beverage comprising:

a liquid containing cup having an open upper end thereof;

a lid sealably connectable onto the open upper end of said cup;

said cup also including an elongated cylindrical medicine cavity having an open lower end thereof and a narrowing discharge tip in proximity to the open upper end of said cup;

said cavity formed into an outer perimeter surface of, said cup for concealing said cavity;

a medicine plunger slidably engageable for longitudinal movement within said cavity for discharging liquid medicine from said discharge tip responsive to movement of said plunger into said cavity, a lower distal end of said plunger always remaining above a bottom of said cup wherein the cup is always supportable atop a horizontal surface;

said lid having a tapered upwardly extending drinking spout having a first drinking port in fluid communication only with the interior of said cup and a second port spaced adjacent to said first port in fluid communication only with said cavity wherein liquid beverage in said cup may be dispensed from said first port by gravity feed by tipping said device to elevate liquid beverage in said cup above said first drinking port and liquid medicine in said medicine cavity may be independently dispensed from said second port by moving said plunger into said cavity the liquid beverage and the liquid medicine being un-commingled prior to being dispensed from respective said ports.

2. A liquid dispensing device for the selective oral administration of a liquid medicine simultaneously with a liquid beverage comprising:

a liquid containing cup formed as a unit having an open upper end thereof;

a lid sealably connectable onto the open upper end of said cup;

said cup also including an elongated cylindrical medicine cavity having an open lower end thereof and a narrowing discharge tip in proximity to the upper end of said cup;

said cavity formed as a unit with, and being concealingly positioned and extending into an outer perimeter surface of said cup;

an elongated medicine plunger sealingly engageable for longitudinal movement within said cavity for discharging liquid medicine from said discharge tip responsive to movement of said plunger into said cavity;

said cavity and said plunger cooperatively configured in length of said plunger and in height and length of said cavity to allow free finger access to fully push the outer end of said plunger into said cavity while also allowing said cup to be supported in an uptight orientation on a flat surface with said plunger in any extended position within said cavity;

said lid having a tapered upwardly extending drinking spout having a first drinking port in fluid communication only with the interior of said cup and a second port spaced adjacent to said first port in fluid communication only with said cavity wherein liquid beverage in said cup may be dispensed from said first port by gravity feed by tipping said device to elevate liquid beverage in said cup above said first drinking port and liquid medicine in said cavity may be selectively dispensed from said second port by moving said plunger toward said discharge tip in said cavity, the liquid medicine being isolated from the liquid beverage until both are discharged from respective said ports.

3. A liquid dispensing device for the selective oral administration of a liquid medicine simultaneously with a liquid beverage comprising:

a liquid containing cup having an open upper end thereof for holding a quantity of liquid beverage therein;

a lid sealably connectable onto the open upper end of said cup;

said cup also including an elongated cylindrical medicine cavity having an open lower end thereof and an elongated upwardly extending discharge tip having an open upper distal end thereof in proximity to the open upper end of said cup;

said medicine cavity formed as a unit with and longitudinally extending within, an outer perimeter surface of, said cup for concealing said medicine cavity;

a medicine plunger sealingly engageable for longitudinal movement within said medicine cavity for discharging liquid medicine from said discharge tip responsive to finger movement of said plunger;

an enlarged clearance cavity coaxially extending from said medicine cavity to a bottom of said cup wherein said device is supportable in an upright position on said bottom in any position of said plunger;

said lid having a tapered upwardly extending drinking spout having a conical-like side surface and a truncated upper distal end surface which includes two spaced first drinking ports in fluid communication with the interior of said cup and a second port positioned between, and in close proximity to, said first ports and having an elongated connecting tube downwardly extending from said second port, said connecting tube being sealingly engaged with said discharge tip when said lid is connected to said cup establishing isolated fluid communication between said medicine cavity and said second ports wherein liquid beverage in said cup may be dispensed from said first ports by gravity feed by tipping said device to elevate liquid beverage in said cup above said first ports and liquid medicine in said medicine cavity may be selectively dispensed from said second port by finger movement of said medicine plunger into said medicine cavity.

4. A liquid dispensing device as set forth in claim 3, further comprising:

a raised lip formed around and upwardly extending from said upper distal end surface for enhanced mixing of liquid beverage and liquid medicine just prior to entering the child's mouth.

* * * * *